US009204714B2

(12) United States Patent
Coste

(10) Patent No.: US 9,204,714 B2
(45) Date of Patent: Dec. 8, 2015

(54) COLLAPSIBLE CLEANING DEVICE

(76) Inventor: Julien Jean Georges Coste, Bompas (FR)

( * ) Notice: Subject to any disclaimer, the term of this patent is extended or adjusted under 35 U.S.C. 154(b) by 82 days.

(21) Appl. No.: 14/128,598

(22) PCT Filed: Jul. 4, 2012

(86) PCT No.: PCT/FR2012/051555

§ 371 (c)(1),
(2), (4) Date: Dec. 21, 2013

(87) PCT Pub. No.: WO2013/004969

PCT Pub. Date: Jan. 10, 2013

(65) Prior Publication Data

US 2014/0143967 A1 May 29, 2014

(30) Foreign Application Priority Data

Jul. 5, 2011 (FR) ..... 11 56052

(51) Int. Cl.

| | |
|---|---|
| ***A47L 13/51*** | (2006.01) |
| ***A47L 13/52*** | (2006.01) |
| ***B25G 1/04*** | (2006.01) |
| ***A46B 7/02*** | (2006.01) |
| ***A46B 5/00*** | (2006.01) |
| ***A46B 15/00*** | (2006.01) |
| ***B25G 3/18*** | (2006.01) |

(52) U.S. Cl.

CPC ..... *A46B 15/0095* (2013.01); *A46B 5/005* (2013.01); *A46B 5/0033* (2013.01); *A46B 7/02* (2013.01); *A46B 7/026* (2013.01); *A46B 15/00* (2013.01); *A47L 13/51* (2013.01); *A47L 13/52* (2013.01); *B25G 1/04* (2013.01); *B25G 3/18* (2013.01); *A46B 2200/302* (2013.01)

(58) Field of Classification Search

CPC ..... A47L 13/51; A47L 13/52; A46B 7/00; A46B 7/023; A46B 7/026; A46B 2200/302; A46B 5/00; A46B 5/0004; A46B 5/0012; A46B 5/0033; A46B 5/0041; A46B 5/0045; A46B 15/00; A46B 15/0095; A46B 17/04; B25G 1/04

USPC ..... 15/144.1, 144.3, 144.4, 172, 184, 201, 15/203, 257.2; 206/15.3, 361, 576

See application file for complete search history.

(56) References Cited

U.S. PATENT DOCUMENTS

| | | | | |
|---|---|---|---|---|
| 345,069 | A | 7/1886 | Nash | |
| 3,324,494 | A | 6/1967 | Vosbikian | |
| 4,793,646 | A * | 12/1988 | Michaud, Jr. | 294/210 |
| 5,661,868 | A | 9/1997 | Panagakos et al. | |
| 5,943,727 | A | 8/1999 | Freer | |
| 7,600,287 | B1 | 10/2009 | Moore | |
| 2005/0097691 | A1 * | 5/2005 | Tsuchiya et al. | 15/144.4 |

FOREIGN PATENT DOCUMENTS

| | | |
|---|---|---|
| DE | 730904 | * 1/1943 |
| FR | 2030457 | * 11/1970 |
| FR | 2760961 | 9/1998 |

* cited by examiner

*Primary Examiner* — Mark Spisich

(74) *Attorney, Agent, or Firm* — Andrew W. Chu; Craft Chu PLLC

(57) ABSTRACT

The collapsible cleaning device includes a broom and a pan. The broom has a brush provided with bristles on the bottom surface thereof and secured by the top surface thereof to the end of a handle. The pan has a plate provided on at least one of the edges thereof with a wall projecting from the top face as well as a gripper secured to the wall. The brush is hinged to pass from a retracted position extending along the handle to an extended position extending orthogonally relative to handle, and vice versa.

10 Claims, 3 Drawing Sheets

FIG. 1
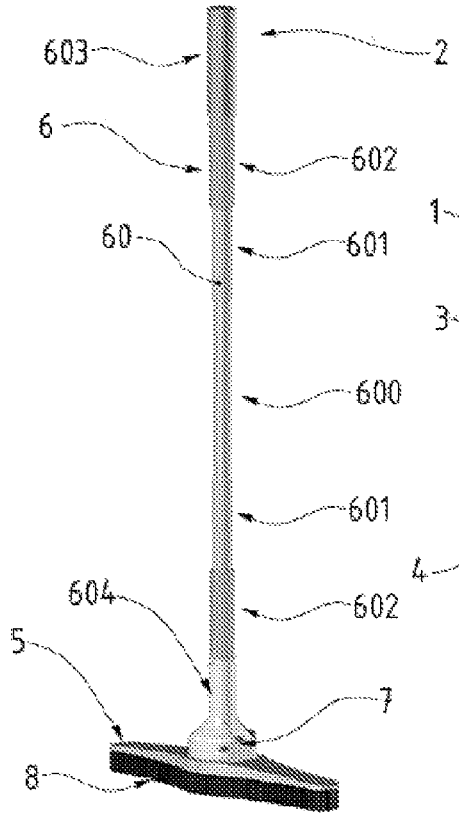
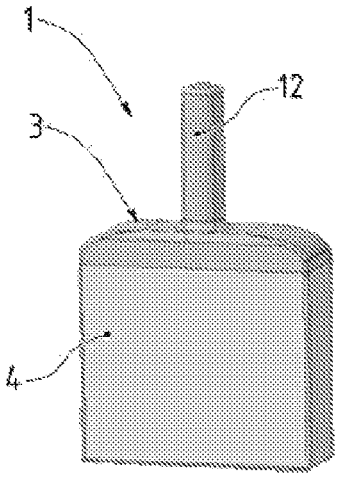
FIG. 2
FIG. 3
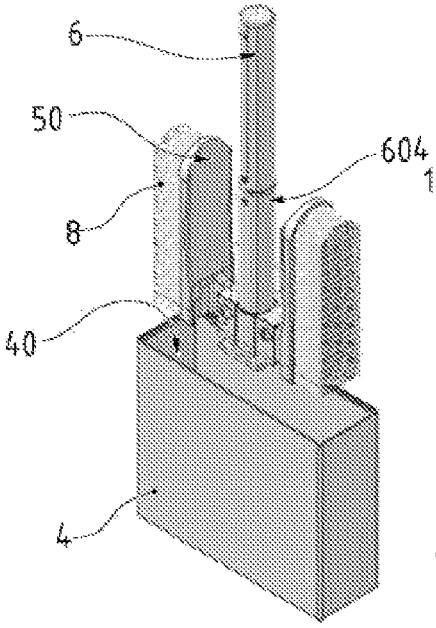
FIG. 4
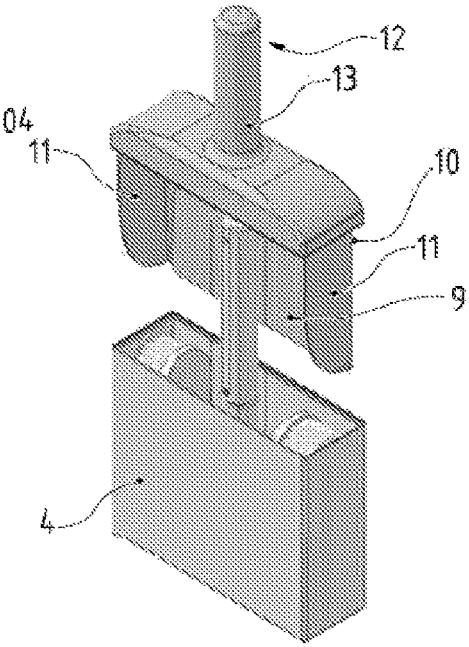

FIG.8
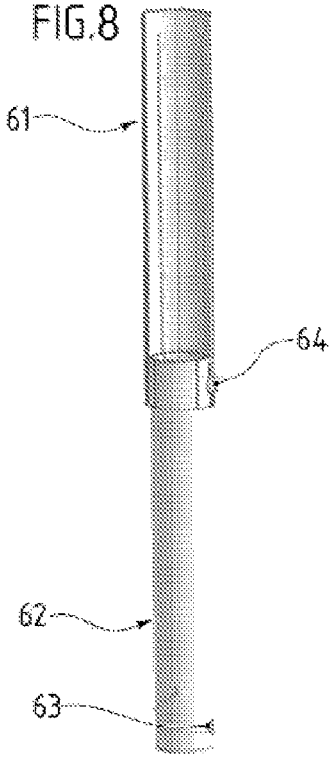
FIG. 11
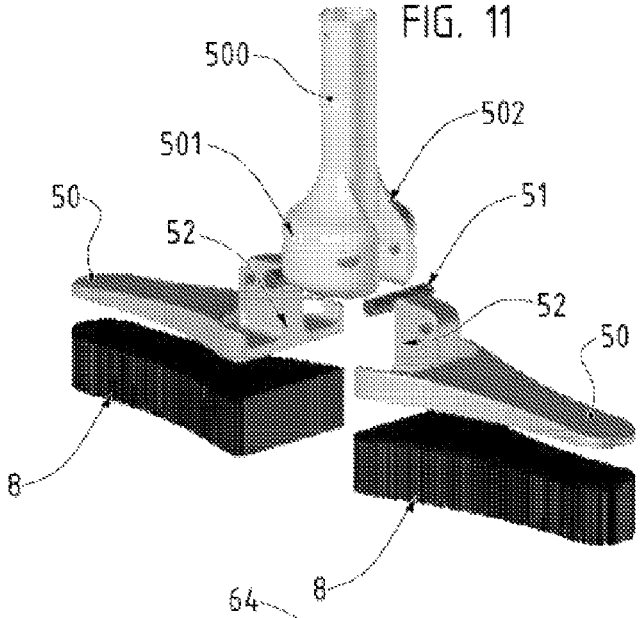
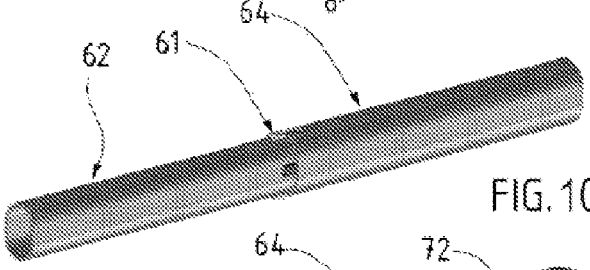
FIG. 10A
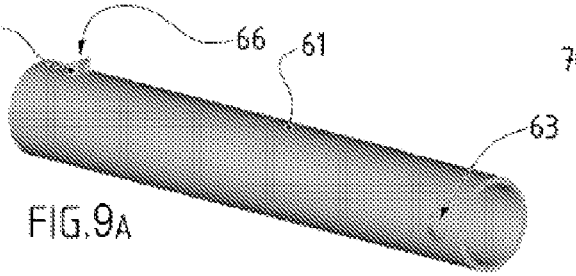
FIG.9A
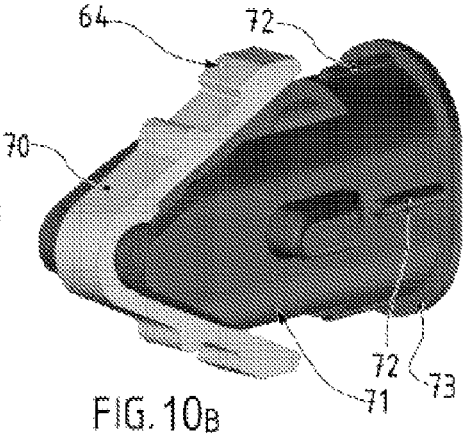
FIG. 10B
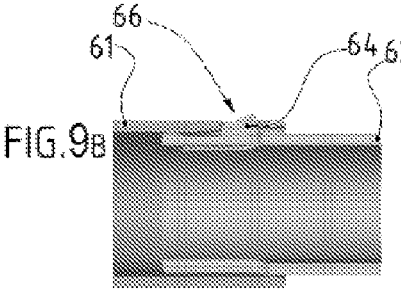
FIG.9B
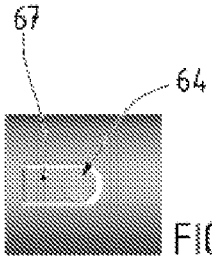
FIG.9C

COLLAPSIBLE CLEANING DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention falls within the field of house maintenance, cleaning and housework.

The invention relates in particular to a collapsible cleaning device made up of a broom and a pan.

2. Description of Related Art Including Information Disclosed Under 37 CFR 1.97 and 37 CFR 1.98.

In a known way, the sweeping of a surface, e.g. the floor, requires a broom and a pan to pick up dust, debris and other materials laying on said surface. Such a broom has a brush made integral with a handle serving as gripping means and permitting its handling for sweeping, then to pick up by pushing said dust and the like inside said pan.

More specifically, said brush has an elongated shape, receiving at its lower face bristles made of soft or semi-rigid material and fixed at the level of the center of the upper face to said lower end of said handle, providing said broom with a general inverted T shape.

A major drawback is the length of said handle, more than one meter, which, combined with its T-shape, has a size for its storage, which then requires a dedicated space, usually a cabinet.

In addition, the pan is in the form of a rectangular or square parallelepiped-shaped plate, forming the bottom topped on the upper face, on three of its sides, with protruding walls defining a space for receiving the dust and the like. At the front, the face without a wall permits the introduction of the dust into said space when it is being picked up. Moreover, at the level of the rear wall are provided gripping means made integral with said rear wall and said plate.

Such a pan, having a smaller size, is often stored in the same place as the broom, directly on the floor or, in the best case, hanging within the storage cabinet, often leading to a loss of time when looking for it. That is why it has been devised to hang said pan inside the cabinet or directly on the handle, namely by snapping it onto the handle, so as not to separate these two elements.

An example of removable attaching of a pan to the handle of a broom is described in detail in FR 2,760,961.

However, the size of the broom, to the handle of which is attached its pan, remains problematic.

Another example of a pan- and broom assembly is disclosed in U.S. Pat. No. 345,096 and is comprised of a handle in the form of a single tube, to the lower end of which are directly fixed the bristles of the brush. A pan has a hollow tubular handle, permitting to insert said handle by its upper end and the sliding of said pan until it arrives into locking position at its lower end at the level of the brush.

In this condition, while sweeping the person handling said broom adopts a standing position, using the length of the handle to gather said dust and the like. Once gathered in the form of a pile, this dust and the like must be pushed into the pan, which requires the person to flex down, typically by squatting, and then to handle the broom at the level of the brush and the lower portion of the handle. This handling is tedious because of the tilting of the handle around the grip at the bottom. Most of the time, during the picking up, the person then uses a hand brush to push the dust and the like inside the pan.

In order to cope with this drawback, a telescopic handle has been devised, designed to pass from an extended position into a folded position, and vice versa. An example of such a telescopic handle is disclosed in U.S. Pat. No. 5,661,868. A brush is mounted at the lower end of a handle comprised of several sections in the form of tubular sleeves of different diameters. In particular, a lower sleeve has a diameter smaller than the inner cross-section of the adjacent upper sleeve. Therefore, each lower sleeve slides inside and along its contiguous upper sleeve.

Furthermore, this document describes a pan, inside which said brush can be positioned in folded position, the handle of said pan being in the form of a half cylinder and the interior of the pan having the shape of a parallelepiped, providing a space for receiving the straight brush of said broom.

SUMMARY OF THE INVENTION

The present invention is aimed at coping with the drawbacks of the state of the art by providing a collapsible cleaning device comprised of a broom and a pan, which pretends to be able to facilitate its storage by reducing its size, while making it easier to be used.

To this end, such a device is designed hinged so as to pass from a folded position for storage to an extended position for its use, and vice versa. In particular, on the one hand, the brush is designed foldable, so as to pass from a retracted position.

Thus, the foldable cleaning device according to the invention is comprised of a broom and a pan, said broom being comprised of a brush provided with bristles on its lower face and made integral at its upper surface with the lower end of a handle, said pan being formed, on the one hand, of a plate provided at least on one of its edges with a wall protruding at the upper face and, on the other hand, with gripping means made integral at the level of said wall.

Advantageously, it is characterized in that said brush is hinged so as to pass from a retracted position extending along said handle into an extended position extending orthogonally relative to said handle, and vice versa.

Furthermore, the handle of the broom is designed telescopic, so that it can be folded, reducing its height and, on the other hand, the pan constitutes the storage space for said broom and its handle in folded position. An additional advantage of the invention lies in the folding of the handle, then transforming the broom into a hand brush, facilitating the operation of picking up the dust and the like into the interior of the pan.

Thus, said handle can be telescopic, so as to pass from a folded position to an extended position, and vice versa, said gripping means being designed hollow and constituting a housing for receiving said telescopic handle in folded position.

According to further features, said handle can be formed of cylindrically shaped sections slidably mounted relative to each other, and said gripping means are in the form of a tube of an internal cross-section equal to or larger than the outer cross-section of the section having the largest diameter of said handle.

According to a particular embodiment, each segment can have a tubular shape and, for a first and a second slidably mounted segment, said first segment of a larger diameter comprises an orifice shaped so as to receive a push-button mounted on said second segment, so as to constitute a stop.

According to another embodiment, for a first and a second slidably mounted segment, said first segment of a larger diameter comprises, on its inner surface, guiding means in the form of a complementarily shaped groove or catch, so as to mutually cooperate with a catch or a groove provided for on the outer face of said second segment.

According to yet another embodiment, said pan can comprise, on three of its edges, side walls protruding at the upper face, defining an inner space, said inner space being sized so as to receive said brush in the retracted position.

According to yet another embodiment, said brush can be formed of two hinged side wings rotationally mounted at the level of the lower end of said handle according to a quarter-round stroke.

According to yet another embodiment, said device comprises storing means in the form of a hollow parallelepiped-shaped casing, provided with an opening at the level of at least one side thereof, forming a housing sized so as to receive internally through insertion said pan.

Further features and advantages of the invention will become clear from the following detailed description of an embodiment not limiting the invention, with reference to the attached figures.

BRIEF DESCRIPTION OF THE DRAWINGS

FIG. 1 shows a perspective view in unfolded and extended vertical positions of a preferred embodiment.

FIG. 2 shows a perspective view of the embodiment of FIG. 1, in folded and retracted positions for storage.

FIGS. 3 and 4 show similar perspective views of such a device during two stages of storing.

FIG. 8 shows a perspective view of two segments of the broom in the unfolded position.

FIGS. 9A, 9B and 9C show three details according to different views (perspective, sectional, and elevation) of the locking together of the segments in the extended position;

FIGS. 10A and 10B respectively show perspective views of two segments sliding relative to each other in the extended position and a preferred way of locking of said segments.

FIG. 11 shows an exploded perspective view of a specific embodiment of the hinged brush of said cleaning device.

DETAILED DESCRIPTION OF THE DRAWINGS

Figure 5:
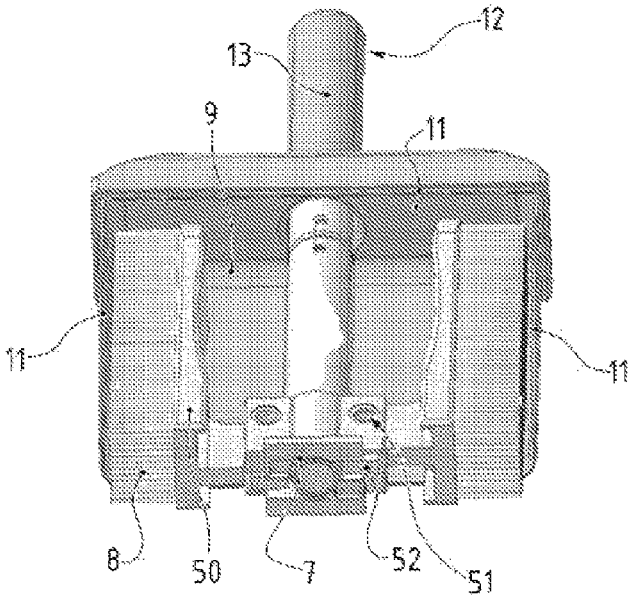
FIG. 5 shows a perspective view of the encasing of the broom in folded position into the pan.

The present invention relates to a collapsible cleaning device 1. In particular, said device 1 is designed hinging so as to be unfolded for use and folded for storage and putting away.

Such a device 1 is comprised of a broom 2 and a pan 3.

Furthermore, as can be seen in FIG. 1, said broom 2 is formed of a brush 5 made integral at the upper face with the lower end of a handle 6. In particular, said brush 5 is fixed to said handle 6 at its center, through fixing means 7. In addition, said brush 5 is provided on the lower surface with bristles 8. These can be made of any material, natural, composite or plastic material, or metal, preferably flexible or semi-rigid material.

According to another feature, said pan 3 is comprised of, on the one hand, a plate 9 provided on a least one of its edges 10, a wall 11 protruding on the upper face and, on the other hand, gripping means 12 made integral, at the level of said wall 11.

It should be noted that said gripping means 12 can be integral with said protruding wall 11, at the level of its rear outer face, or directly with said plate 9, or with both at the same time.

In particular, according to the preferred embodiment, said pan 3 can be formed of a rectangular or square parallelepiped-shaped plate 9 topped on its upper face, at the level of three of its peripheral edges 10, with three walls 11. The last edge is left free, in order to provide an opening. Thus, said pan 3 has an upper inner space, open at one side, in order to insert the dust and other waste into it at the time of picking up.

Advantageously, said handle 6 can be telescopic so as to pass from a folded position to an unfolded position, and vice versa. Thus, in the folded position, the broom 2 is like a brush.

According to a first feature, said handle 6 can be formed of segments 60. The latter are thus designed telescopic, i.e. they are designed movable in translation relative to each other, so as to retract or extend. Once retracted, the segments 60 are all nested into each other, whereby the length of said handle 6 is then equivalent to that of the longest segment, receiving internally or externally the other segments.

It should be noted that said segments 60 can have complementary circular, ovoid or polygonal cross-sections. According to the preferred exemplary embodiment, said segments 60 have a cylindrical or substantially cylindrical shape. Furthermore, they can be designed hollow.

According to the embodiment shown in FIG. 9B, it should be noted that said segments have a truncated conical shape, namely one end has a larger diameter than the opposite end, as schematically shown in FIG. 9A. Moreover, a central segment 600 can be designed cylindrical and with a smaller diameter, while the other, adjacent segments 601 have larger cross-sections and the end segments 602 have yet larger cross-sections. Said cross-sections are sized so as to allow the various segments 600, 601 and 602 to be inserted and slide inside each other.

It should be noted that said handle 6 can also include upper 603 and lower 604 segments, whereby the latter can be made integral with said brush 5.

Furthermore, said segments 60 can be slidably mounted with respect to each other, but they can also be designed unfoldable and foldable, through screwing and unscrewing.

Moreover, said segments 60 can be locked at least in the unfolded position, in order to maintain said handle 6 longitudinally rigid during its use. To this end, each segment 60 has a tubular shape and, for a first 61 and second 62 slidably mounted segment, said first segment 61 having a larger diameter comprises an opening 63 shaped so as to receive a push-button 64 mounted on said second segment 62, so as to form a stop. Thus, by sliding into the extended position, the push-button 64, mounted in a springy restoring way into a protruding position, snaps through encasement into said orifice 63, having a complementary cross-section, and locks the translation of the two segments 61 and 62 with respect to each other. A detail of this preferred type of locking is schematically shown in FIGS. 9A, 9B and 9C.

Conversely, a simple pressure on said push-button 64 permits to unlock the two segments 61 and 62, permitting again the sliding.

As such, the release of said push-button 64 can occur manually, or during the sliding of another segment of larger diameter, which then presses when passing into the folded position.

In this configuration, said button 64 can have an upper face 66 inclined, depending on the longitudinal translation direction, to the side of said upper segment, so as to facilitate the sliding and the resting of this segment.

According to a first embodiment, shown in FIGS. 9A, 9B and 9C, said push-button 64 is formed of a cut-out in the wall of the segment, one end 67 remaining connected to the remainder of said wall. In this configuration, said segment is made of a plastic material providing the elasticity characteristics necessary for the deformation of the so formed tongue 67 and its return into its original position.

According to another embodiment, shown in FIGS. 10A and 10B, said push-button 64 is formed by an independent elastic blade 70. More specifically, said blade 70 can have a V-shape and said button 64 is divided and formed of each free end of this blade 70. The latter then cooperate with two orifices 63.

Preferably, said blade 70 is mounted on a tip-shaped support 71. This shape allows it to be inserted into and at the level of the end of a segment. This support 71 has namely longitudinal catches 72 extending protruding along its outer surface, so as to lock it during its insertion by force into said segment. Moreover, a peripheral flange extending protruding around the outer end of said support 71 can serve as a stop during its insertion and penetration into said segment.

It is also possible to freely choose the length of the handle 6. In particular, it is possible to fully retract it, so as to form a hand brush, easier to handle to push the dust and debris into the pan 3 at the time of their picking up.

Figure 7:
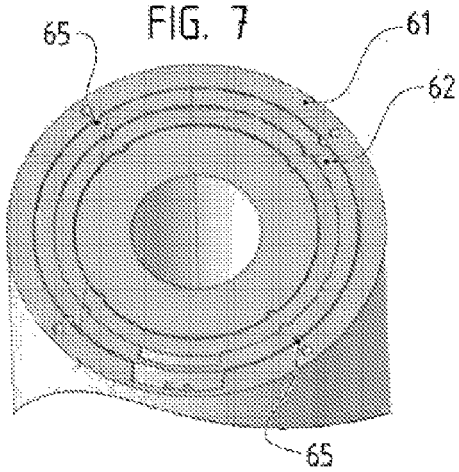
FIG. 7 shows a perspective view of a detail of the segments of said brush in the folded position.

Furthermore, in order to prevent the segments 60 from rotating relative to each other during their sliding, said device 1 includes guiding means, Such means are visible in the cross-sectional view of FIG. 7.

In particular, for a first 61 and second 62 slidably mounted segment, said first segment 61 having a larger diameter comprises, on its inner surface, guiding means in the form of a complementarily shaped groove or catch 65, so as to cooperate mutually with a catch or groove 65 provided for in the outer face of said second segment 62. According to the embodiment shown in FIG. 7, four grooves are arranged in a rectilinear manner inside and along the outer wall of the segment having the smallest diameter 62, forming grooves, inside which catches, namely in the form of protruding straight lines extending along the inner wall of said first segment 61 having the largest diameter, insert and slide internally and longitudinally, preventing the rotation of said segments 61 and 62 relative to each other.

Moreover, said guiding means can constitute locators so as to allow only one single encasement, hence, the sliding of the segments relative to each other. In the case of grooves 65, this feature can result into a different number of grooves 65 and an identical number of catches, depending on the segments. In brief, a first segment has two grooves on its outer face and the second segment of a larger diameter, which slides over same, has, in turn, two corresponding catches. However, this second segment can have three grooves externally, which cooperate with the three catches of a third segment of a yet larger diameter. Furthermore, the location of said grooves and catches prevents, through a different angle, a segment having three grooves from cooperating with a segment having only two catches. Thus, it is not possible to assemble, especially during the initial mounting, segments that do not correspond to each other.

According to another feature, said gripping means 12 allow the user to handle said pan 3. In addition, they are designed hollow and form a housing for receiving said telescopic handle 6 in the folded position.

To this end, said gripping means 12 are in the form of a tube 13 with an inner cross-section equal to or larger than the outer cross-section of the segment of larger diameter of said handle 6. In addition, this tube 13 can have a length larger than or equal to the length of the longest segment of the handle 6. Thus, said handle 6, in the folded position, is received within the gripping means 12, making integral the pan 3 and the broom 2, as shown in FIG. 5.

Advantageously, an essential feature resides in that said brush 5 is hinged, so as to pass from a retracted position extending along said handle 6 to an extended position extending orthogonally relative to said handle 6, and vice versa.

To this end, said brush 5 is divided into two elements in the form of two side wings 50. The latter are mounted hinging about an axis of rotation 51 at the level of the lower end of said handle 6 according to a quarter-round stroke. Indeed, in the retracted position, said wings 50 abut against said handle 6, while in the extended position, said wings 50 are locked in front of each other for continuously forming said brush 5. The locking of the stroke for unfolding can be achieved by stops 52, visible in FIG. 5, or by the very shape of said L-shaped wings 50, which are locked against each other at the level of their right angle.

Furthermore, according to a particular embodiment, shown in FIG. 11, each wing 5 can be designed removable, so as to be separated for their replacement. In particular, it is possible to interchange different types of brushes depending on the desired use, including a holder for a mop, a towel, a wipe, a cloth or the like.

It should be noted that means can be provided, especially by snapping-on or through a removable pin or by magnetism, to keep the wings 50 locked in the extended position, in order to prevent any retraction during sweeping.

Figure 6A:
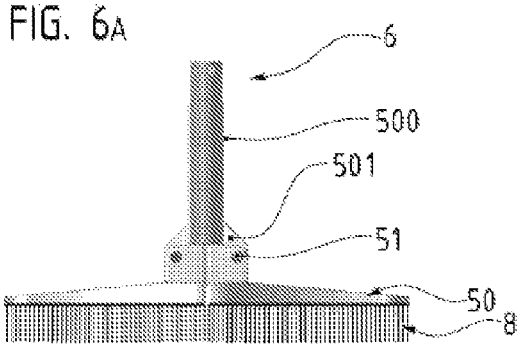
FIGS. 6A, 6B and 6C show elevation views of a detail during the passage from the extended position to the retracted position of the brush.
Figure 6B:
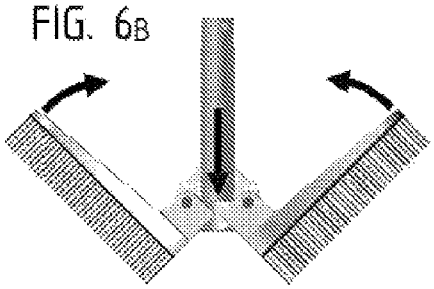
Figure 6C:
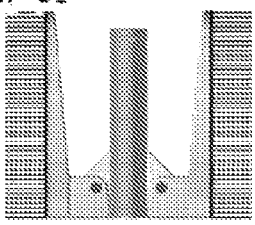

In addition, as can be seen in FIGS. 6B and 6C, during the folding of the handle 6 an inner segment can push the stops 52 of each wing 50, involving the quarter-round rotary motion, so that said wings 50 return into the retracted position, as shown by the arrows in FIG. 6B. Conversely, the retraction of said segment permits to replace said wings 50 in the extended position.

According to the preferred embodiment, said brush 5 is comprised of a segment 500 constituting the lower segment of said handle 6. This segment 500 has a specifically shaped base 501—more widened—so as to receive said axes of rotation 51 of said wings 50. Said base 501 also comprises two recesses 502 permitting to receive the wings 50 in the retracted position.

In addition, said inner space of the pan 3 is dimensioned so as to receive said brush 5 in the retracted position. In brief, during the insertion of the handle 6 folded within the tube 13, the brush 5 is accommodated in the space 20 provided by the pan 3. More particularly, the dimensions of said space are larger than the size of the brush 5 in the retracted position, so that it does not protrude. Moreover, the protruding walls 11 protect the bristles 8 of each wing 50, also helping to maintain said brush 5 retracted within said pan 3, due to the friction of said bristles 8 against the inner face of the walls 11.

According to a preferred embodiment, visible in FIGS. 2 to 4, said device 1 can also comprise storage means, in the form of a hollow parallelepiped-shaped casing, provided with an opening 40 at the level of at least one of its faces, preferably its upper face, constituting a housing sized to receive internally by insertion said pan 3 as well as said brush 5 in the retracted position and said handle 6 in the folded position within said gripping means 12. The casing then serves as a storage means by providing a smaller size, without the bristles 8 protruding, since the latter always keep encrusted dust or particles.

Furthermore, according to an additional feature, magnetic means (not shown) can be positioned so as to ensure maintaining some elements of said device 1 together. In particular, the segments 60 of the handle 6, the casing 4, the pan 3, its tube 13 or the wings 50 of the brush 5 may include magnets to help keeping them together and a simple manipulation by the user, namely pulling, allows the magnetically imposed release.

Thus, the invention comprised of its broom 2 with a handle 6 with foldable segments 50 and its brush 5 with retractable wings, these hinged elements being combined with a pan 3 dimensioned so as to enable them to be accommodated therein, ensures a device having a minimum size for its storage, while providing a broom of a flexible size during its use.

I claim:

1. A collapsible cleaning device, comprising:

a broom being comprised of a brush and a handle, said brush having a lower face provided with bristles and an upper surface attached to said handle, said handle being comprised of a plurality of cylindrical segments telescopically engaged to each other, said handle having an upper end and a lower end, wherein said plurality of cylindrical segments is comprised of inner cylindrical segments, and a terminal cylindrical segment at said lower end, wherein said handle has a folded position with said cylindrical segments housed within each other, said inner cylindrical segments being housed within said terminal cylindrical segment, wherein said handle has an unfolded position with at least one cylindrical segment extended from an adjacent cylindrical segment, wherein said brush is comprised of two hinged side wings pivotally mounted at said lower end of said handle, each side wing having an extended position orthogonal to said handle and a retracted position parallel to said handle, said two hinged side wings abutting each other in respective extended positions so as to form said brush in said extended position, wherein each side wing pivots between said extended position and said retracted position by a quarter rotation of a respective axis of rotation at said lower end of said handle, wherein each side wing comprises a stop protruding inward toward said handle, wherein an inner cylindrical segment sliding through said terminal cylindrical segment actuates each side wing between said extended position and said retracted position by engaging respective stops of each side wing; and a pan being comprised of a plate, a wall attached to an edge of said plate, and a gripping means made integral with said wall, said brush in said retracted position being slideable within said pan.

2. The collapsible cleaning device, according to claim 1, said inner cylindrical segment sliding through said terminal cylindrical segment engaging each stop of a respective side wing so as to push each side wing from each other, each side wing moving from said extended position to said retracted position, said handle in said folded position.

3. The collapsible cleaning device, according to claim 1, said inner cylindrical segment sliding back through said terminal cylindrical segment releasing each stop of a respective side wing, each side wing abutting each other, each side wing moving from said retracted position to said extended position.

4. The collapsible cleaning device, according to claim 1, further comprising a locking means engaged to said inner cylindrical segment sliding through said terminal cylindrical segment, said locking means holding said inner cylindrical segment sliding through said terminal cylindrical segment relative to said terminal cylindrical segment.

5. The collapsible cleaning device, according to claim 4, wherein said locking means is comprised of a snap fit means.

6. The collapsible cleaning device, according to claim 4, wherein said locking means is comprised of a magnet.

7. The collapsible cleaning device, according to claim 1, wherein said terminal cylindrical segment is comprised of a base with two recesses at said lower end, each recess pivotally engaging a respective side wing.

8. The collapsible cleaning device, according to claim 1, wherein said gripping means are comprised of a tube, said terminal cylindrical segment of said handle being housed in said tube, said brush and said handle being housed in said gripping means and said pan, when said brush is in said retracted position and said handle is in said folded position.

9. The collapsible cleaning device, according to claim 1, wherein said pan further comprises side walls along remaining edges of said plate, said wall and said side walls defining an inner space, said brush in the retracted position being housed in said inner space.

10. The collapsible cleaning device according to claim 1, further comprising:

a hollow parallelepiped-shaped casing having at least one side with an opening, said pan being slideable through said opening so as to be housed within the casing.

* * * * *